US006079853A

United States Patent [19]

Evans

[11] Patent Number: 6,079,853

[45] Date of Patent: Jun. 27, 2000

[54] CAMMED ROTATING GOBOS

[75] Inventor: Nigel Evans, Birmingham, United Kingdom

[73] Assignee: Light & Sound Design, Ltd., Birmingham, United Kingdom

[21] Appl. No.: 08/951,946

[22] Filed: Oct. 17, 1997

Related U.S. Application Data

[60] Provisional application No. 60/028,965, Oct. 18, 1996.

[51] Int. Cl.[7] ..... F21V 14/00

[52] U.S. Cl. ..... 362/324; 362/323; 362/282; 362/283; 362/284

[58] Field of Search ..... 362/319, 322, 362/321, 323, 324, 277, 281, 280, 282, 283, 284

[56] References Cited

U.S. PATENT DOCUMENTS

| | | | |
|---|---|---|---|
| 917,368 | 4/1909 | Seidel | 362/324 |
| 2,133,608 | 10/1938 | Engelken | 362/324 X |
| 2,856,831 | 10/1958 | Gipe et al. | 362/321 X |
| 4,037,097 | 7/1977 | Shuman et al. | 362/324 |
| 4,811,182 | 3/1989 | Solomon | 362/321 X |

*Primary Examiner*—Laura K. Tso
*Attorney, Agent, or Firm*—Fish & Richardson P.C.

[57] ABSTRACT

A light altering device includes a housing and at least one moveable element coupled to the housing with each of the moveable elements having a light modifying device capable of changing some aspect of a beam of light. A moving control element moves the moveable element(s) relative to the housing between a first stowed position where the light modifying device of the moveable element does not interfere with the beam of light, and a second active position where the light modifying device does interfere with the beam of light. The housing of the light altering device can rotate a lighting effect produced by the moveable element in the second active position. Methods of modifying light with the device are also disclosed.

25 Claims, 4 Drawing Sheets

CAMMED ROTATING GOBOS

CROSS REFERENCE TO RELATED APPLICATIONS

This application claims the benefit of U.S. Provisional Application Ser. No. 60/028,965, filed Oct. 18, 1996.

BACKGROUND OF THE INVENTION

The present invention relates to rotating light pattern modifiers or gobos.

A gobo is a device which alters a pattern of light to form a projected light pattern. Gobos have been used in stage lighting for a variety of special effects.

In the stage lighting context, the lighting designer often wants to select one of a number of different gobos for placement in the light beam. It is also desirable that the selected gobo be capable of rotation.

Different ways of carrying out the selection and rotation of gobos are known. One technique, described in U.S. Pat. No. 4,891,738, locates a plurality of gobos on the periphery of a rotatable wheel. Rotation of the wheel places the proper gobo at the proper location. A separate device then rotates the selected gobo within the wheel.

Another rotating technique is described in U.S. Pat. No. 5,537,303. This technique selects a gobo by rotation of a gobo wheel until the selected gobo is within the light path. All of the gobos on the wheel are simultaneously rotated by a central sun gear.

SUMMARY OF THE INVENTION

The present invention features a light altering device which includes a housing capable of having light project along a light path through a housing surface and at least one moveable element coupled to the housing. Each of the moveable elements include a light modifying device capable of changing some aspect of the beam of light, and an arm having a first end which connects to the light modifying device and a distal end with a pivot surface. A moving control element, such as a cam, is rotatably mounted on the housing surface and includes a pressing surface which contacts the pivot surface of the arm. A bias element is connected to the housing to produce a bias force which maintains the moveable element in a first stowed position where the light modifying device does not interfere with the beam of light. Rotation of the moving control element by means known in the art moves the pressing surface along the pivot surface and overcomes the bias force to pivot the moveable element between the first stowed position, and a second active position where the light modifying device does interfere with the beam of light. The housing of the light altering device rotates to rotate a lighting effect produced by the moveable element in the second active position.

The present invention features a device to form a projected light pattern which includes a gobo wheel capable of having light project through the wheel and with at least one moveable gobo on the wheel. A rotatably mounted cam element on the wheel moves the gobo between a stowed position and an optically active position to modify the light. Preferably, the gobo wheel has light projecting along an optical axis through the center of the wheel, and the optically active position of the gobo is coaxial with the optical axis.

In an alternative embodiment, the moveable elements include a first moveable element located in a first plane on a first side of the housing and a second moveable element located in a second plane on a second side of the housing. The second side of the housing is closer to the beam of light than the first side of the housing.

In an alternative embodiment, the stowed position is preferably located at the periphery of the housing and the active position is located at the center of the housing. A single moveable element is located in the active position and a plurality of moveable elements are located in the stowed position.

In an alternative embodiment, a release device on the housing prevents the moveable element from contact with the moving control element when the moveable element is in the first stowed position. The bias device maintains the moveable element in contact with the release device which can include physical stops. The moving control element moves the moveable element to the second active position by overcoming the bias force. This technique offers the advantage of no or reduced noise due to the moveable element contacting the moving control element only at selected times and locations.

The present invention also features a method for modifying projected light including the steps of projecting light through a gobo wheel having at least one moveable gobo and a cam element rotatably mounted on a surface of the wheel which contacts a moveable gobo. The method then moves the gobo or gobos on the wheel between a stowed position and an optically active position to modify the light. This is accomplished by rotating the cam element to overcome a bias force produced by a bias device.

The present invention describes an alternative technique which allows several important advantages. First, according to one aspect of the present invention, the selected gobo is positionally moved into the path of the light beam.

A second aspect of the present invention is that the physically-selected gobo is moved to the center of the wheel, and the optical axis of the projected light is through the center of the wheel. This opens new alternatives for positioning and packaging relative to the above-described systems.

Yet another aspect of the invention teaches techniques where a camming surface is used to physically move the gobo into its selected position.

DESCRIPTION OF THE PREFERRED EMBODIMENTS

Figure 1:
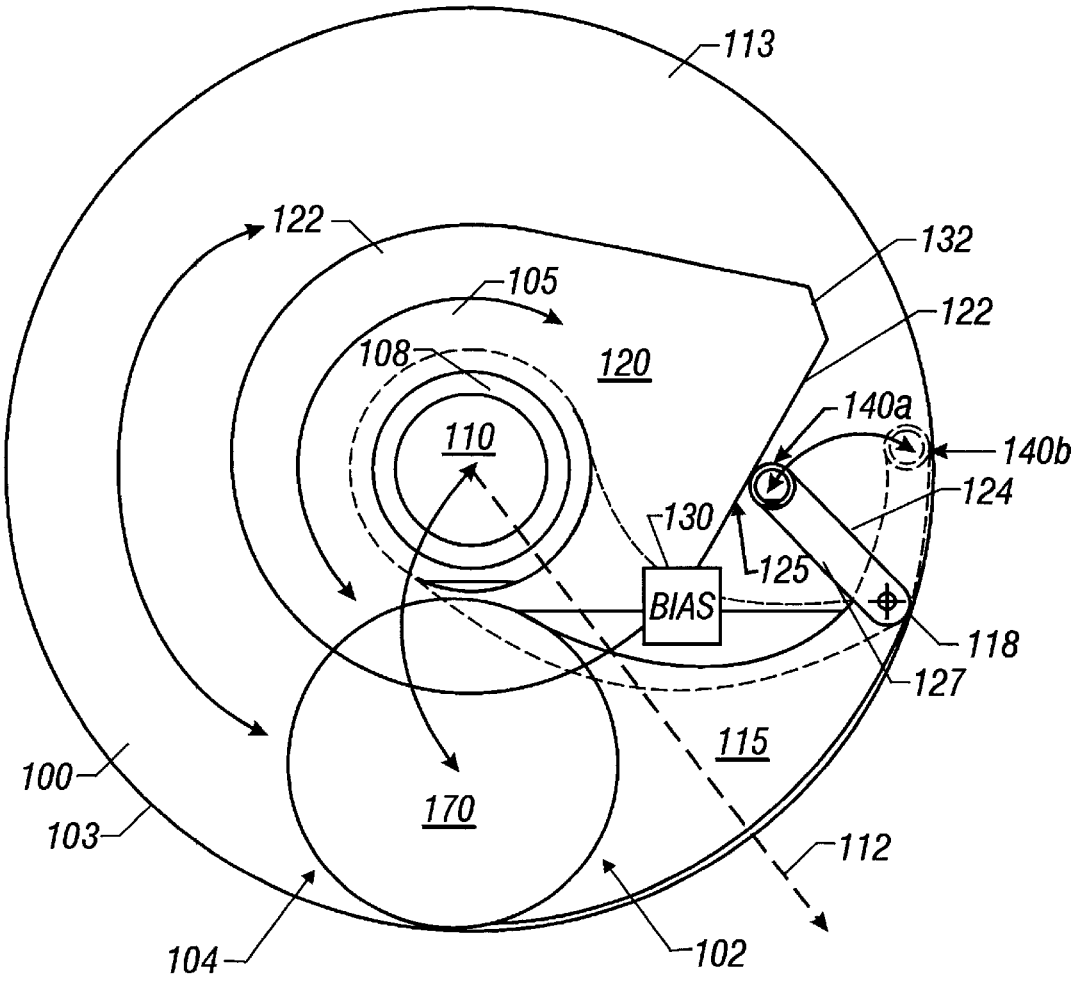
FIG. 1 illustrates a moveable light modifying element on a housing.
Figure 1A:
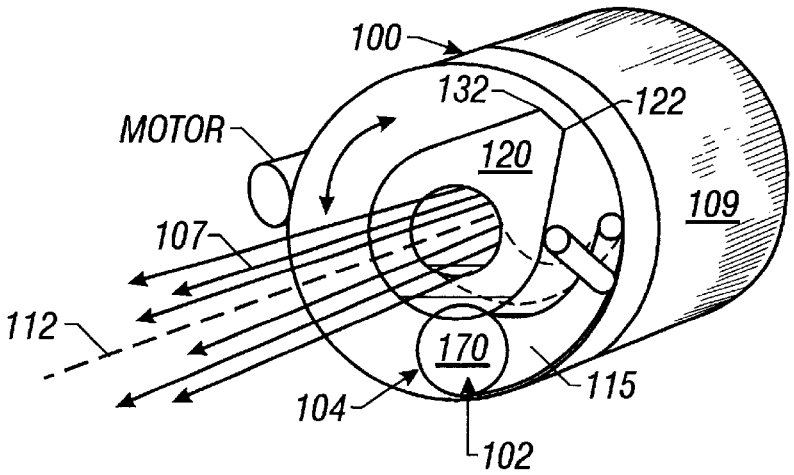
FIG. 1A illustrates a housing with a light source projecting light through the housing.

Referring to FIGS. 1 and 1A, a housing 100, such as a gobo wheel, is shown and includes a moveable element 102, such as a gobo. The gobo is moveable between a stowed position 104 near the periphery 103 of the gobo wheel 100, and an active position 108 towards the central area 105 of the gobo wheel 100. Light 107 from a light source 109 to be projected on a stage is projected along an optical axis 112 which extends substantially through the central area 105 of gobo wheel 100.

Moveable gobo 102 contains a light modifying device 170 and is connected to an arm 115, such as a gobo-moving element, which preferably includes a gobo tail piece 127 having a distal end with a gobo pivoting or moving surface 124. The gobo 102 and arm 115 pivot between the two positions shown in FIG. 1, preferably by use of a hinge 118 which couples the gobo 102 and arm 115 to the housing 100. The stowed position is shown as 104 where the gobo 102 is located near the periphery 103 of the gobo wheel 100, and the gobo 102 does not interfere or obstruct light 107 which projects through the central area 105. The gobo can also be moved into an optically-active position 108, toward the center area 105 of the wheel 100. In the optically active position 108, the gobo 102 with light modifying device 170 interferes, modifies, obstructs, or patterns light 107 as it projects through gobo wheel 100. Preferably, the optically-active position is coaxial with the optical axis 112 which runs through the center 105 of the wheel 100.

Pivoting of the gobo 102 between positions is preferably carried out according to this embodiment using a moving control element 120, such as a cam. Cam element 120 includes an outer pressing surface 122 which presses against gobo moving surface 124, preferably the distal end of the gobo tail piece 127, located at a first position 140*a*. The gobo moving surface 124 can be any surface which pushes against cam element 120 as it rotates. The outer pressing surface 122 is preferably an edge 125 of the cam element 120. The edge 125 preferably contacts gobo moving surface 124 as the cam element 120 is rotated by means known in the art. When pressing surface 122 is in the position shown in FIG. 1, a spring-biased element 130 holds the gobo in its stowed outermost position 104.

The spring-biasing element 130 holds the gobos in position by one of two techniques. One way is that the spring keeps the gobo moving surface 124 pressed against the cam 120. This allows the gobo moving surface 124 to follow the cam 120 and engage the cam pressing surface 122 as the cam 120 rotates. This forces the gobo 102 against the stowed position when required.

Figure 1B:
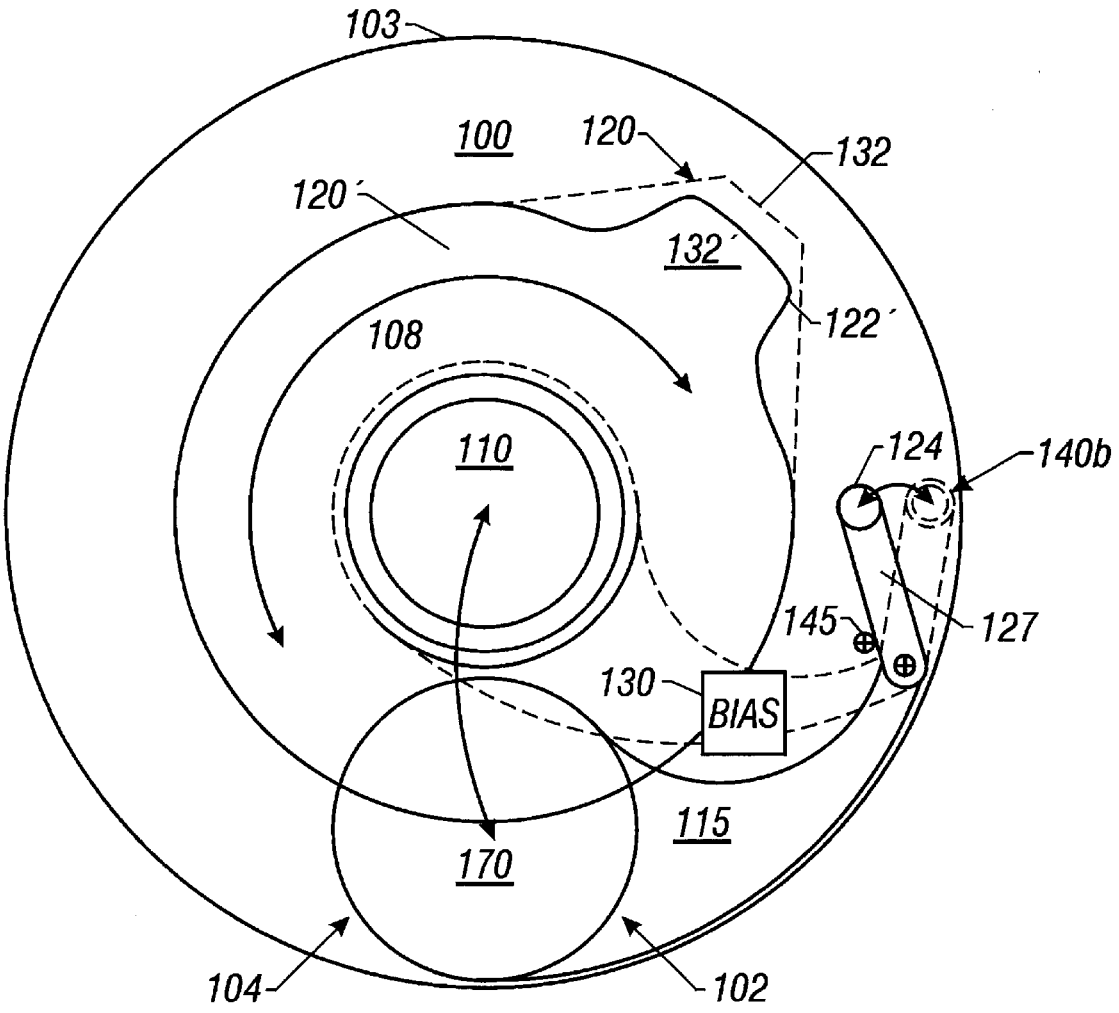
FIG. 1B illustrates a moveable light modifying element held in a stowed position by a release device.

As shown in FIG. 1B, a preferred technique places release devices or physical stops 145, such as pins, on or near the perimeter of the wheel. These physical stops 145 allow the gobo moving surfaces 124 to break contact with the cam 120 (shown in phantom in FIG. 1B) when the gobo moving surfaces 124 are not required, ie., when the gobo 102 is not in the optically active position 108. The bias force keeps the gobo tail piece 127 against the physical stop 145 and prevents the distal end with gobo moving surface 124 from touching the pressing surface 122 when the gobo is in the stowed position. Contact between the gobo moving surface 124 and the cam element 120 is only made when the extended portion 132 rotates to engage the gobo moving surface 124.

Since contact between gobo moving surface 124 and cam element 120 is required for less time, the release device technique allows for a variety of different shapes for cam elements such as cam element 120', which have different configurations for their extended portion 132' and pressing surface 122'. When cam 120' is rotated to contact gobo moving surface 124, the spring-bias allows the cam 120' to have the extended portion 132' press the gobo tail piece 127 against the exterior of the wheel 103.

The release devices 145 are preferably located a distance from the periphery 103 of the housing 100 which allows the cam element 120 to rotate without contacting the release device 145, yet physically prevents gobo moving surface 124 from contacting cam 120. This location can vary depending on the shapes and sizes of cam elements 120, gobos 102, etc. This release device technique is preferred due to its expected lowered physical noise from less vibrations and less contact of the cam 120 against the gobo moving surface 124 during rotation of the cam 120.

Figure 3:
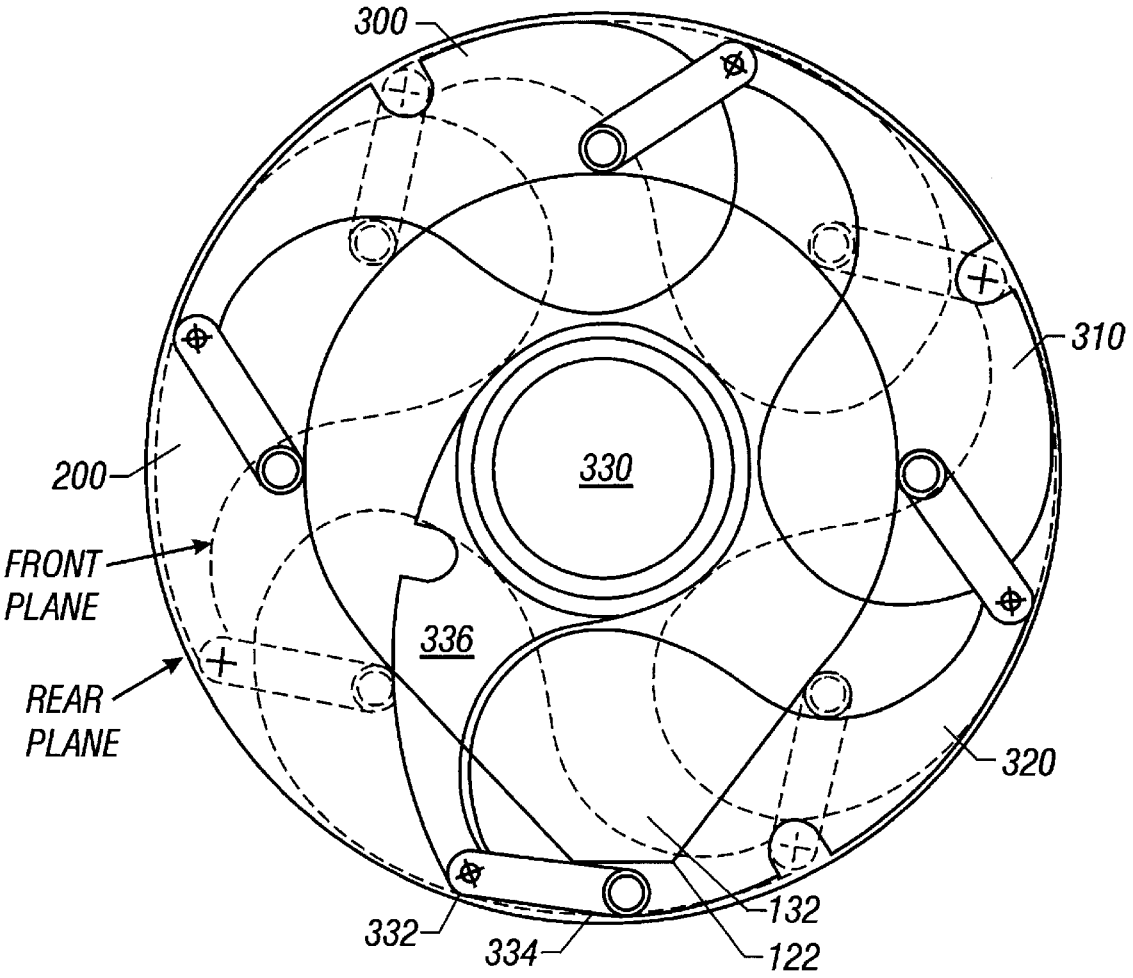
FIG. 3 illustrates a plurality of moveable light modifying elements occupying multiple planes on a housing.

In either technique, the cam element 120 is rotated and an extended portion 132 of pressing surface 122 of cam element 120 eventually rotates to the proper position shown in FIG. 3. The extended portion 132 presses against gobo moving surface 124 to move it to second position 140*b*, preferably at or near the periphery 103 of wheel 100. In this manner, the pressure of the pressing surface 122 against the gobo moving surface 124 as the cam element 120 is rotated overcomes the bias force produced by bias element 130. This swings the movable gobo into its optically active and preferably centrally located second position where it modifies the pattern of the light being projected.

Once the gobo is located in its central location, rotation of gobo wheel 100 correspondingly rotates the centrally located gobo and thereby rotates the lighting effect created by the gobo's light modifying device 170 in the optically active position. FIG. 1 shows the principle applied with a single gobo, but it should be understood that the principle can also be applied with multiple gobos as shown in FIGS. 2 and 3.

Figure 2:
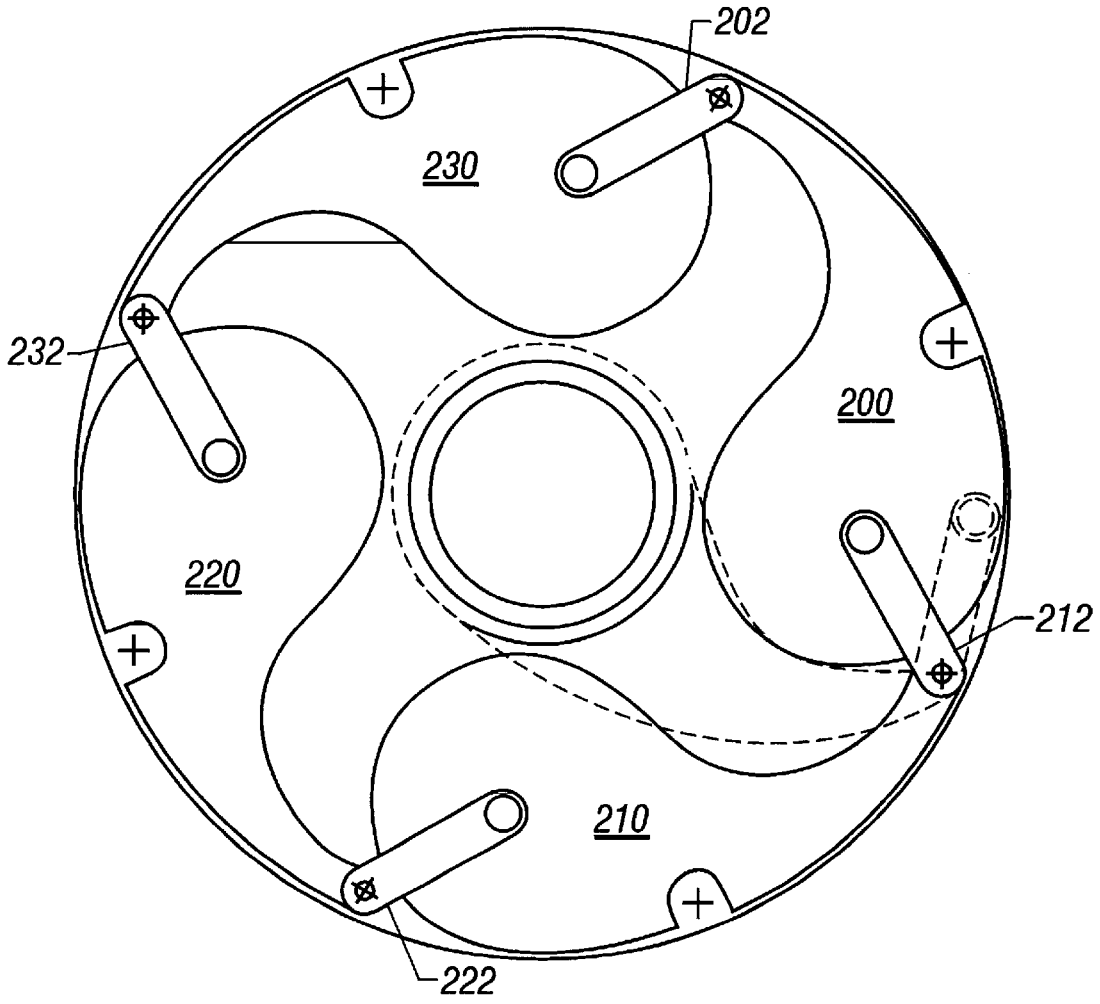
FIG. 2 illustrates a plurality of moveable light modifying elements on a housing.

FIG. 2 shows four gobo moving elements 200, 210, 220, and 230. Any of these gobo moving elements is moved to the active position when the extended surface 132 of the cam 120 presses against the appropriate moving member 202, 212, 222, and 232. As the cam 120 rotates, a variety of gobos 200, 210, 220, 230 can provide a plurality of patterns, colors, designs, etc. for the light which is projected. Those skilled in the art will note that by varying items such as the rotation speed of the cam 120 or the distance between gobos elements, control over the projected light pattern is maintained.

FIG. 3 shows the principle extended for use with eight gobo moving devices. In this case, the four gobo moving devices from FIG. 2 occupy a first plane and are shown in phantom in FIG. 3. Another four gobo moving devices 300, 310, 320, and 330 are located in the optical path; either on the same, or on the opposite surface of the unit. The other four gobo moving devices also allow their associated gobo to be moved into the active position. Essentially, the operation becomes three dimensional, with four of the gobos (200, 210, 220, 230) occupying one plane and the other four gobos (300, 310, 320, 330) occupying another plane. FIG. 3 shows these gobos being located out of phase with respect to one another, i.e., such that the cam position does not engage more than one gobo at a time. However, it should be understood that appropriate selection of the camming surface could allow these gobos to be in any desired location relative to one another.

The preferred technique places both gobos on the same surface. This leaves free the opposite surface of the wheel which can be used to mount the wheel for rotation, i.e., by a bearing assembly. The double-sided gobo device is less preferred, but still useable, and could use smaller bearings on the perimeter of the wheel, for example.

In operation, as the camming surface 122 is rotated, it alternately presses each gobo moving surface, such as 334. Pressing the distal end and surface 334 rotates the associated gobo moving device 336 on its pivot 332 to locate the associated gobo 330 into the central, optically active, position. As the cam 120 continues to rotate, the gobo moving device 336 is slowly lowered in response to cam pressing surface 122 releasing gobo moving surface 334 from its peripheral position. This moves gobo 330 out of its optically-active position and back into its stowed position. The continued rotation of the cam 120 raises a subsequent gobo into the active position.

In this way, rotation of the cam surface 122 selects the gobos by locating them into the central optically active position. Rotation of the entire unit rotates the selected gobo.

Although only a few embodiments have been described in detail above, those having ordinary skill in the art will certainly understand that many modifications are possible in the preferred embodiment without departing from the teachings thereof.

What is claimed is:

1. A light altering device comprising:

an optical element holder;

at least one movable element coupled to said optical element holder;

said at least one movable element having a light modifying device capable of changing some aspect of a beam of light;

a moving control element coupled to said optical element holder, said moving control element moving said at least one movable element relative to said optical element holder between a first stowed position where said light modifying device does not interfere with said beam of light, and a second active position where said light modifying device does interfere with said beam of light, wherein said optical element holder rotates to rotate a lighting effect produced by only said at least one movable element in said second active position.

2. The light altering device of claim 1 wherein said moving control element has a pressing surface to physically move said at least one movable element between said first stowed position and said second active position based on rotation of said optical element holder.

3. The light altering device of claim 2 further comprising a bias device connected to said housing to produce a bias force, and said pressing surface contacts a movement surface to overcome said bias force to physically move said at least one moveable element.

4. The light altering device of claim 3 wherein said pressing surface has an extended portion which rotates to press against said movement surface and overcome said bias force.

5. The light altering device of claim 1 further comprising said at least one movable element having a first movable element in said first stowed position and a second movable element in said second active position.

6. The light altering device of claim 1 wherein said optical element holder has a periphery and a center;

said first stowed position is located at said periphery;

said second active position is located at said center; and said at least one movable element comprises a single movable element in said second active position and a plurality of movable elements in said first stowed position at any time.

7. The light altering device of claim 1 wherein said at least one movable element comprises a rotating cam rotated by rotation of said optical element holder, and arm having a first end connected to said light modifying device and a distal end contacting said moving control element.

8. The light altering device of claim 7 wherein said distal end has a pivot surface, and said distal end contacts said moving control element along said pivot surface.

9. A device as in claim 1, wherein said light modifying device is a gobo that changes a shape of the beam of light.

10. A light altering device comprising:

an optical element holder;

at least one movable element coupled to said optical element holder;

said at least one movable element having a light modifying device capable of changing some aspect of a beam of light;

a moving control element coupled to said optical element holder, said moving control element moving said at least one movable element relative to said optical element holder between a first stowed position where said light modifying device does not interfere with said beam of light, and a second active position where said light modifying device does interfere with said beam of light, wherein said optical element holder has a center and a periphery, said beam of light projects along an optical axis coaxial with said center of said optical element holder, said second active position is coaxial with said optical axis and said first stowed position is on said periphery.

11. A device as in claim 10, wherein said light modifying device is a gobo that changes a shape of the beam of light.

12. A light altering device comprising:

an optical element holder;

at least one movable element coupled to said optical element holder;

said at least one movable element having a light modifying device capable of changing some aspect of a beam of light;

a moving control element coupled to said optical element holder, said moving control element moving said at least one movable element relative to said optical element holder between a first stowed position where said light modifying device does not interfere with said beam of light, and a second active position where said light modifying device does interfere with said beam of light, wherein said at least one movable element includes a first movable element located in a first plane on a first side of said optical element holder, and a second movable element located in a second plane on a second side of said optical element holder, said second side of said optical element holder closer to said beam of light than said first side of said optical element holder.

13. A light altering device comprising:

an optical element holder;

at least one movable element coupled to said optical element holder; said at least one movable element having a light modifying device capable of changing some aspect of a beam of light;

a moving control element coupled to said optical element holder, said moving control element moving said at least one movable element relative to said optical element holder between a first stowed position where said light modifying device does not interfere with said beam of light, and a second active position where said light modifying device does interfere with said beam of light, wherein said at least one movable element contacts said moving control element in said second active position, and a release device on said optical element holder prevents said at least one movable element from contact with said moving control element when said at least one movable element is in said first stowed position.

14. The light altering device of claim 13 further comprising a bias device connected to said housing to produce a bias force which maintains said at least one moveable element in contact with said release device when said at least one moveable element is in said first stowed position, and said moving control element overcomes said bias force to move said at least one moveable element to said second active position.

15. A light altering device comprising, an optical element holder with a surface capable of having light project through said surface;

at least one movable element having an arm coupled to said optical element holder and a light modifying device capable of changing some aspect of a beam of light;

said arm having a first end and a distal end, said first end connected to said light modifying device and said distal end having a pivot surface;

a moving control element rotatably mounted on said surface, said moving control element having a pressing surface contacting said pivot surface of said arm;

a bias element connected to said optical element holder to produce a bias force which maintains said at least one movable element in a first stowed position where said light modifying device does not interfere with said beam of light, whereby rotation of said moving control element overcomes said bias force to pivot said at least one movable element between said first stowed position, and a second active position where said light modifying device does interfere with said beam of light.

16. The light altering device of claim 15 wherein said optical element holder has a center, said light projects along an optical axis through said center of said optical element holder, and said second active position is coaxial with said optical axis.

17. The light altering device of claim 16 wherein said optical holding element has a periphery and said first stowed position is located at said periphery.

18. The light altering device of claim 15 wherein said at least one movable element includes a first movable element located in a first plane on a first side of said optical element holder, and a second movable element located in a second plane on a second side of said optical element holder, said second side of said optical element holder closer to said beam of light than said first side of said optical element holder.

19. The light altering device of claim 15 wherein said optical element holder rotates to rotate a lighting effect produced by said at least one movable element in said second active position.

20. The light altering device of claim 15 wherein said optical element holder has a periphery and a center;

said first stowed position is located at said periphery;

said second active position is located at said center; and said at least one movable element comprises a single movable element in said second active position and a plurality of movable elements in said first stowed position at any one time.

21. A device as in claim 15, wherein said light modifying device is a gobo that changes a shape of the beam of light.

22. A light altering device comprising, an optical element holder;

an arm coupled to said optical element holder, said arm having a pivot surface;

a light modifying device holding surface holding a light modifying device capable of changing some aspect of a beam of light, said light modifying device holding surface connected to said arm;

a movement surface moved by a movement element, said movement surface contacting said pivot surface to move said light modifying device relative to said optical element holder between a first stowed position where said light modifying device does not interfere with said beam of light, and a second active position where said light modifying device does interfere with said beam of light, said movement element comprising a motor which rotates said movement surface to contact said pivot surface, and thereby causes said light modifying device to move between said first stowed position and said second active position without using said motor to directly move said light modifying device.

23. A device as in claim 22, wherein said light modifying device is a gobo that changes a shape of the beam of light.

24. A light altering device comprising, a housing;

at least one moveable element coupled to said housing;

said at least one moveable element having a light modifying device capable of changing some aspect of a beam of light;

a moving control element coupled to said housing, said moving control element moving said at least one moveable element relative to said housing between a first stowed position where said light modifying device does not interfere with said beam of light, and a second active position where said light modifying device does interfere with said beam of light;

a release device on said housing preventing said at least one moveable element from contact with said moving control element when said at least one moveable element is in said first stowed position and allowing said at least one moveable element to contact said moving control element in said second active position;

a bias device connected to said housing to produce a bias force which maintains said at least one moveable element in contact with said release device when said at least one moveable element is in said first stowed position, and said moving control element overcomes said bias force to move said at least one moveable element to said second active position.

25. A light altering device comprising, a housing;

a plurality of movable elements coupled to said housing, each of said movable elements having a gobo defining a shape that changes a shape of light passing therethrough, and an arm;

said arm having a first end connected to said gobo and a distal end having a pivot surface;

said plurality of movable elements including a first movable element located in a first plane on a first side of said housing and a second movable element located in a second plane on a second side of said housing, said second side of said housing closer to said beam of light than said first side of said housing; and a moving control element coupled to said housing, said moving control element contacting said pivot surface of said arm to selectively move each of said movable elements relative to said housing between a first stowed position where said gobo does not interfere with said beam of light, and a second active position where said gobo does interfere with said beam of light.

* * * * *